US009241859B2

(12) United States Patent
Woog

(10) Patent No.: US 9,241,859 B2
(45) Date of Patent: Jan. 26, 2016

(54) FOLDING TABLE, PORTABLE, IN PARTICULAR MASSAGE TABLE

(76) Inventor: Edouard Ernest Gad Woog, Geneva (CH)

( * ) Notice: Subject to any disclaimer, the term of this patent is extended or adjusted under 35 U.S.C. 154(b) by 187 days.

(21) Appl. No.: 13/816,237

(22) PCT Filed: Aug. 12, 2011

(86) PCT No.: PCT/IB2011/001926

§ 371 (c)(1),
(2), (4) Date: Apr. 10, 2013

(87) PCT Pub. No.: WO2012/020305

PCT Pub. Date: Feb. 16, 2012

(65) Prior Publication Data

US 2014/0190371 A1 Jul. 10, 2014

(30) Foreign Application Priority Data

Aug. 13, 2010 (FR) ..... 10 56592

(51) Int. Cl.

| | |
|---|---|
| ***A47B 3/00*** | (2006.01) |
| ***A61G 13/10*** | (2006.01) |
| ***A47B 3/091*** | (2006.01) |
| ***A61G 13/00*** | (2006.01) |
| ***A47B 3/087*** | (2006.01) |

(52) U.S. Cl.

CPC ..... *A61G 13/105* (2013.01); *A47B 3/087* (2013.01); *A47B 3/0912* (2013.01); *A61G 13/009* (2013.01)

(58) Field of Classification Search

CPC ..... A47B 3/087; A47B 220/0064; A47B 2220/09; A47B 3/083; A61G 13/105; A61G 13/009

USPC ..... 108/34–36, 38, 169, 115, 129–132, 108/167, 168; 248/166, 439; 5/620, 114, 5/111, 316, 174, 179, 180

See application file for complete search history.

(56) References Cited

U.S. PATENT DOCUMENTS

| | | | | | |
|---|---|---|---|---|---|
| 777,186 | A | * | 12/1904 | Dittmer | 108/36 |
| 1,309,049 | A | * | 7/1919 | Syrett | 248/439 |
| 1,511,925 | A | * | 10/1924 | Wasmuth | 108/167 |
| 2,588,405 | A | * | 3/1952 | Munger | 108/34 |
| 2,903,313 | A | | 9/1957 | Block | |
| 3,005,670 | A | | 2/1960 | Schultz | |
| 3,291,078 | A | | 12/1966 | de Saussure | |

(Continued)

FOREIGN PATENT DOCUMENTS

| | | |
|---|---|---|
| FR | 335782 | 8/1903 |
| NE | 131427 | 6/1949 |

*Primary Examiner* — Janet M Wilkens

(57) ABSTRACT

The table comprises a plate (1) made up of at least four sections (1*a*, 1*b*, 1*c*, 1*d*) mounted on rigid articulated frames (2*a*), elements for locking the table in the open position, the plate comprising legs (3) made with at least two parts (3*a*, 3*b*) articulated together, the first parts (3*a*) being articulated to the end sections (1*a*, 1*d*), braces, comprising two arms (7, 8) articulated together, are articulated to the legs (3) and to the end sections (1*a*, 1*d*), locking elements (9, 10) are used between the arms (7, 8) and/or the legs (3), a link (C1) between the articulations (31) of the arms (7, 8) to the end sections (1*a*, 1*d*) on which corresponding legs (3) are hinged, and a lock for the articulation (6) between the parts (3*a*) and (3*b*) of the legs (3) to keep the legs erected and to make the whole rigid, the whole being designed in such a way that the articulated legs and arms, once folded, fold into the frames (2*a*).

11 Claims, 7 Drawing Sheets

(56) References Cited

U.S. PATENT DOCUMENTS

| | | | | | |
|---|---|---|---|---|---|
| 3,357,729 | A | | 12/1967 | Krueger | |
| 4,833,998 | A | * | 5/1989 | Everett et al. | 108/36 |
| 5,009,170 | A | | 4/1991 | Spehar | |
| 5,335,676 | A | | 8/1994 | O'Brien | |
| 5,913,271 | A | | 6/1999 | Lloyd | |
| 5,943,965 | A | * | 8/1999 | Riach et al. | 108/36 |
| 6,000,345 | A | * | 12/1999 | Gillotti | 108/36 |
| 6,076,472 | A | * | 6/2000 | Lloyd | 108/36 |
| 6,192,809 | B1 | * | 2/2001 | Riach et al. | 108/115 |
| 6,705,234 | B1 | * | 3/2004 | Miller et al. | 108/36 |
| D683,031 | S | * | 5/2013 | Du | D24/183 |
| 8,499,386 | B2 | * | 8/2013 | Roleder et al. | 5/620 |
| 2006/0260516 | A1 | * | 11/2006 | Chow | 108/14 |
| 2008/0083068 | A1 | * | 4/2008 | Roleder et al. | 5/646 |

* cited by examiner

FOLDING TABLE, PORTABLE, IN PARTICULAR MASSAGE TABLE

This invention relates to a folding table, portable, in particular a massage table.

TECHNICAL OVERVIEW

Folding tables are known in which the plate is made of two elements folding over each other and with retractable legs (U.S. 2006/260516). We also know of folding tables in which the plate is comprising one element with retractable legs folding in two parts but requiring time and many manipulations to set up, not allowing a construction sufficiently strong and light, for example, for a portable massage table. Finally we know of folding tables whose plate comprises more than two elements (WO 2007/065919), but their general structure does not allow to make a portable massage tables, light, robust and manageable. In the particular field of portable massage tables, so far, one knows of folding tables with two halves which, when folded, have a large volume, making them bulky and difficult to transport. None of these tables were until now sufficiently compact, robust, lightweight and easy to use.

This invention proposes a folding table, which is at the same time easy to use, compact, lightweight and very robust.

To this end, the folding table according to the invention is characterized in that it comprises an elongated plate consisting of at least four elements mounted on rigid frames articulated together perpendicularly to the long side of the plate, means for locking the table in the open position, said plate being connected with legs, each leg being formed of at least two parts articulated together, the first parts being mounted with articulations on a part fixed to the end elements, the length of each part being less than the length of said plate elements; braces, comprising two arms articulated together by a hinge, are articulated to the second part of each leg at each inner end of the end parts of the plate, locking means are used between the braces of each end element and/or the legs of each end element to prevent lateral movement of the table; there are tension cables, linking articulations between the arms of the braces to the point situated above the articulation of the legs on the parts attached to the frame of the end elements, and means for locking the articulation between the parts of the legs to hold the legs in the open position and to make the whole rigid, the whole being designed in such a way that the legs and the articulated arms of each half of the table, once folded, fold into the frames of the adjacent elements, and that all the elements when folded, are superimposed.

Thus we obtain a table whose size when folded is reduced, for example for a massage table, whose installation is quick and easy, and also ensures high strength and stability, supporting high workloads with a very light construction.

According to one embodiment, the table is characterized in that it comprises an elongated plate made of at least four elements mounted on rigid frames articulated together perpendicularly to the long sides of the plate means for locking the table in the open position, said plate having legs, each leg being made of at least two parts articulated together, the first parts being articulated on a part attached to the end elements, the length of each part being less than the length of said elements of the plate, bracing, comprising two arms articulated together are articulated to the second section of each leg and to each inner end of the end elements of the plate, locking means are used between the braces of each end element and/or the legs of each end element to prevent lateral movement of the table, and there are tension cables connecting the articulations between the arms of the braces to the point located above the articulations of the legs on the parts attached to the frame of the end elements and tension cables connecting the legs, at a point above the articulation between the leg to the arm, to the articulations of the bracing with the inner ends of the end parts of the plate to hold the legs in the open position and make the whole rigid, the whole being designed in such a way that the legs and the articulated braces of each half of the table, once folded, fold into the frames of the adjacent elements and that all the elements, once folded, are superimposed.

According to one embodiment, the table is characterized in that in the folded position, the walls of the frames (2*a*) covers at least approximately completely the said parts of the legs and said folded braces.

According to one embodiment, the table is characterized in that each leg comprises a third part sliding on the second part and there are means to fix the two parts together in a desired position for adjusting the height of the table.

According to one embodiment, the table is characterized in that the two end elements of the plate are of a smaller width than the central elements of the plate in a way that in the folded state the lateral parts of the end elements of the plate are covered at least approximately by the parts of the frames of the central elements of the plate.

According to one embodiment, the table is characterized in that supporting means of the central elements comprise surface elements on the adjacent parts of the frames between the end elements and the central elements such that the vertical pressure exerted on the central elements is transmitted to the end elements and there are similar supporting means between the central elements.

According to one embodiment, the table is characterized in that the side parts of the frames of the central elements of the plate are articulated at a point and form, in the open state of the table, a rigid assembly maintaining the central elements of the plate aligned with each other when applying a force F1 on the table.

According to one embodiment, the table is characterized in that means for locking the table in the open position comprise tension cables fixed on one side to the articulations between the two articulated arms of the braces and on the other side to the articulation of the braces with the end elements of the opposite side of the table, or tension cables respectively fixed between the articulations of the braces of the end elements and between the articulations between the two articulated arms of the braces of the end elements, said cables being fixed together by a part.

According to one embodiment, the table is characterized in that means for locking the table in the open position comprise tension cables attached between the articulations located between the two articulated arms of the braces and a point of the adjacent elements respectively.

According to one embodiment, the table is characterized in that means for locking the table in the open position comprise tension cables fixed firstly to the articulations between the two articulated arms of the braces with the end elements of the opposite side of the table and fixed together to their intersection by a part, the part passing through an orifice of a central part fixed and articulated to a part attached to the adjacent parts of the central elements, or tension cables respectively fixed between the articulations of the braces with the end elements and between the articulations located between the two articulated arms of the braces of the end elements, said cables being fixed together by a part, the part passing through the orifice of the central part.

According to one embodiment, the table is characterized in that means for locking the table in the open position comprise tension cables fixed on one side to the articulations between the two articulated arms of the braces and on the other side to the articulations of the braces with the end elements of the opposite side of the table, the cables passing through an orifice of a central part fixed and articulated to a part attached to the adjacent parts of the central elements, or tension cables fixed respectively between the articulations of the braces with the end elements and between the articulations between the two articulated arms of the braces of the end elements, said cables being secured together by a part, the part passing through the orifice of the central part and a cable fixed between the articulations of the braces with the end elements and passing through an orifice situated on the central part.

According to one embodiment, the table is characterized in that the attachment point of the tension cables and to the articulations of the braces to the end elements is removed to the point located above the articulations of the legs on a part of the frames of the end elements said cables passing through a fixed point of the articulation of the braces with the end elements.

DESCRIPTION

The invention will now be described in detail with the following description that refer to the accompanying drawings in which.

Figure 1:
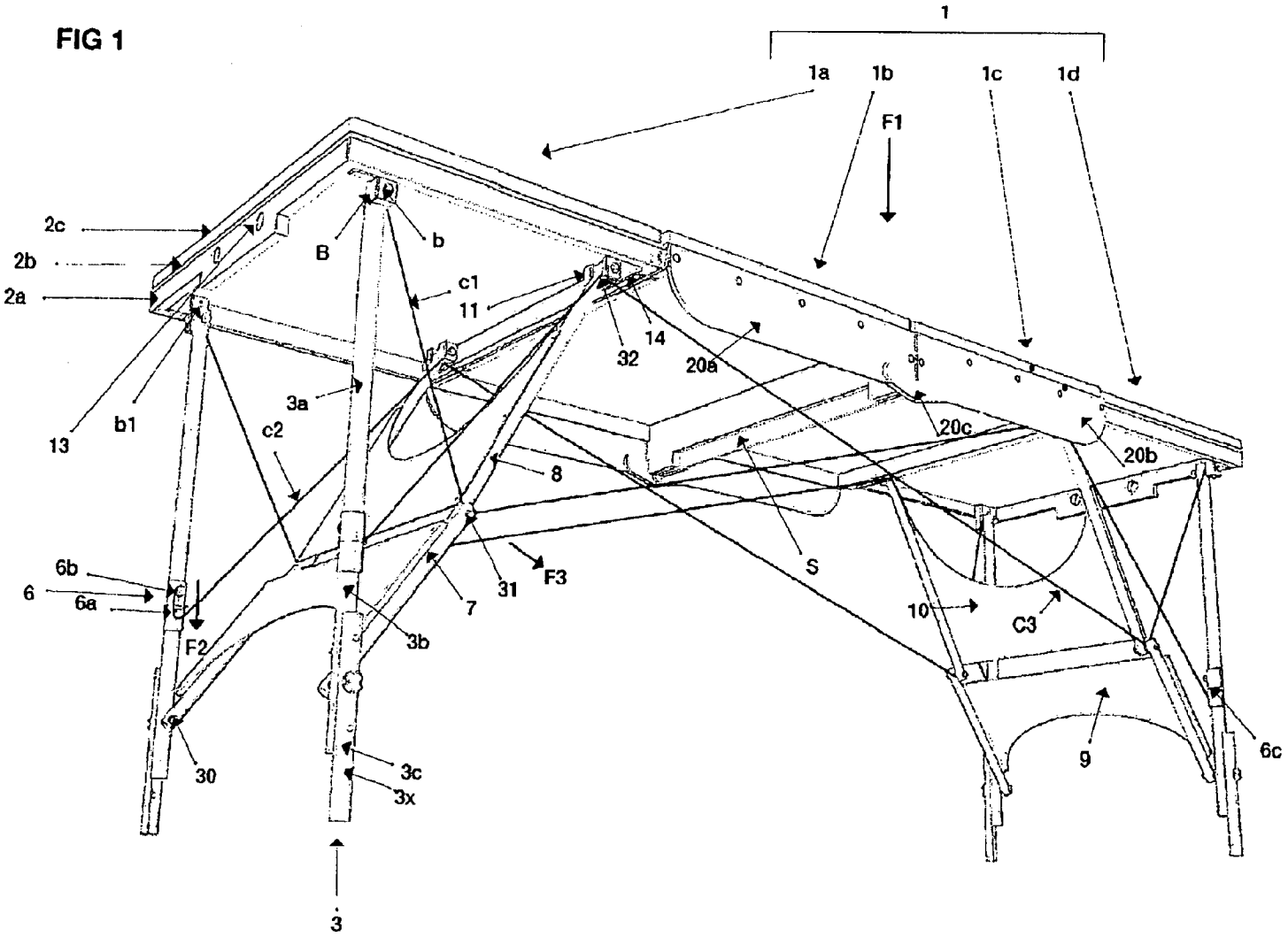
FIG. 1 is an elevation view of one embodiment of the table in the unfolded state.
Figure 1B:
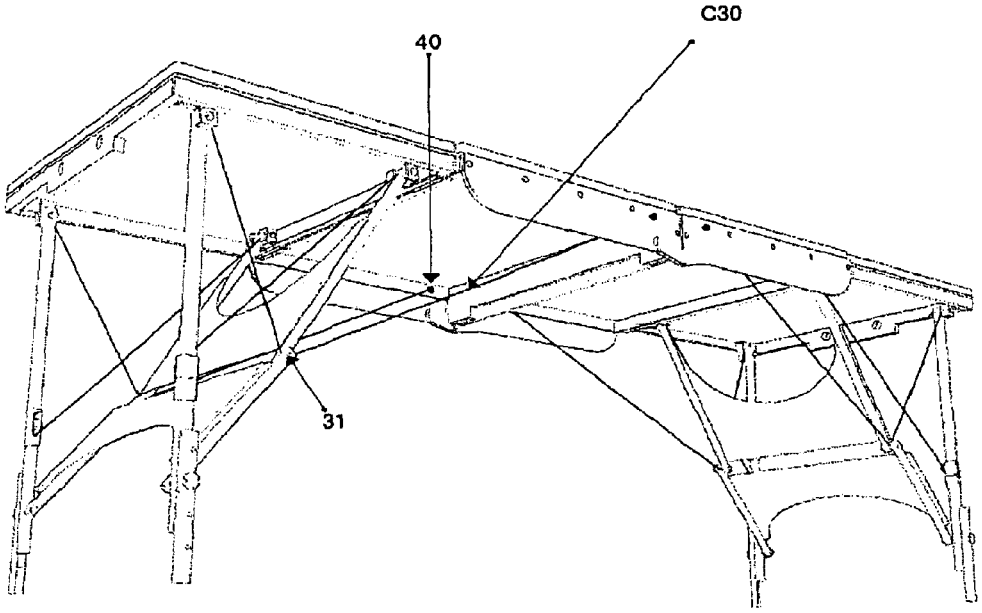

FIG. 1*b* is an elevation view of the table according to a first embodiment.

Figure 6:
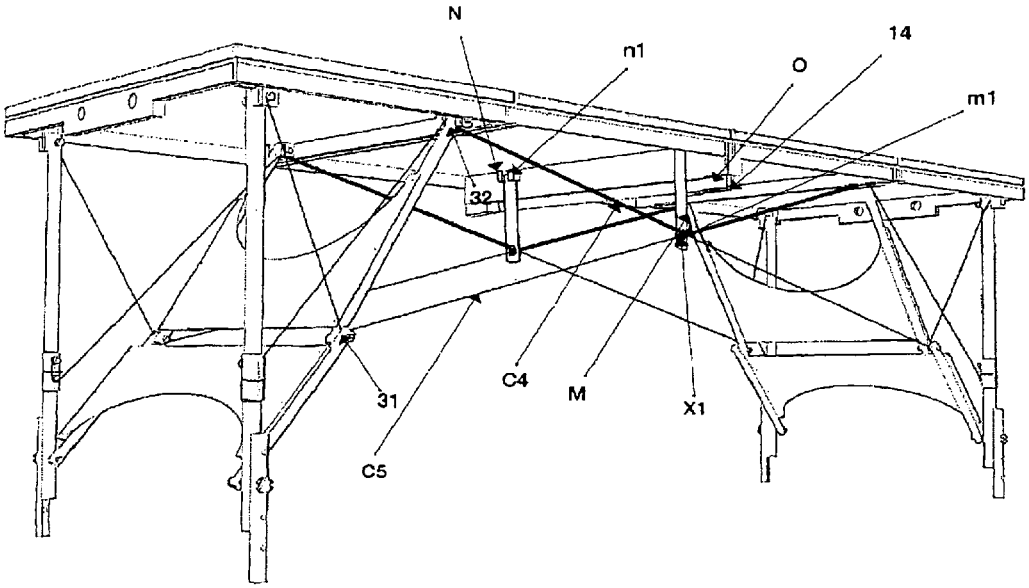

FIG. 6 is an elevation view of the table in the unfolded position of a second embodiment.

Figure 7:
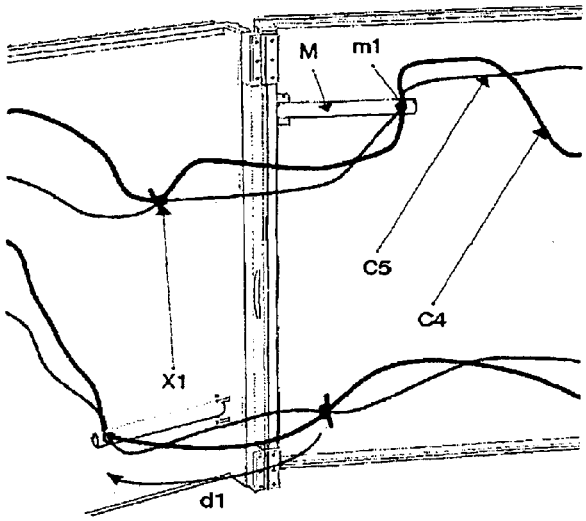

FIG. 7 is an elevation view of the table shown in the intermediate position of folding according to the second embodiment.

Figure 8:
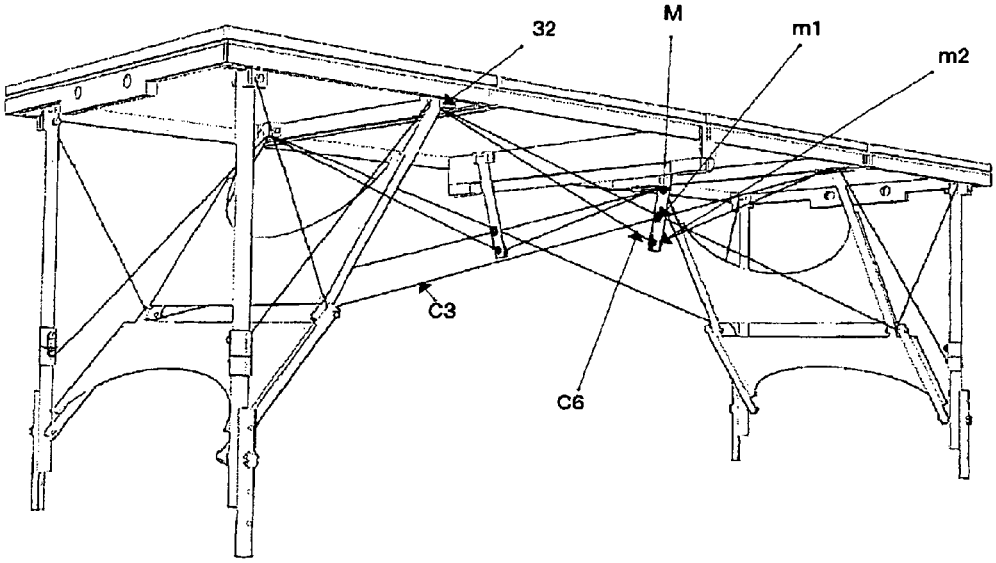

FIG. 8 is an elevation view of the table in the unfolded position in a third embodiment.

Figure 9:
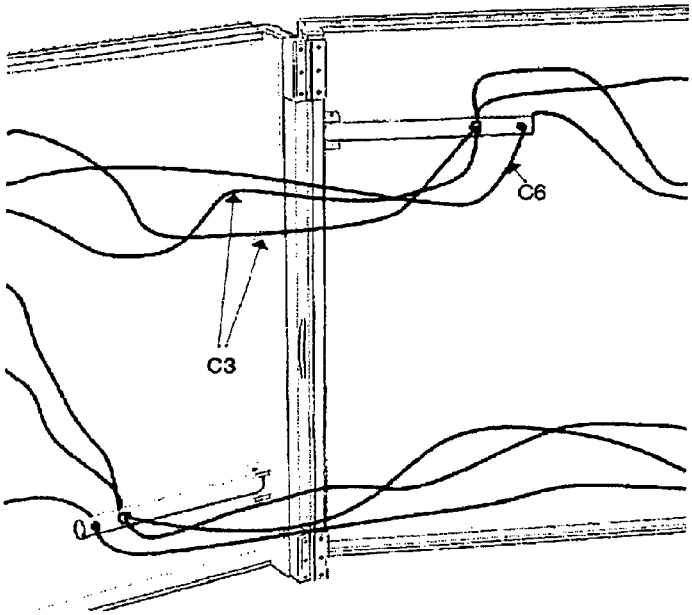

FIG. 9 is an elevation view of the table shown in the intermediate position of folding according to the third embodiment.

Figure 10:
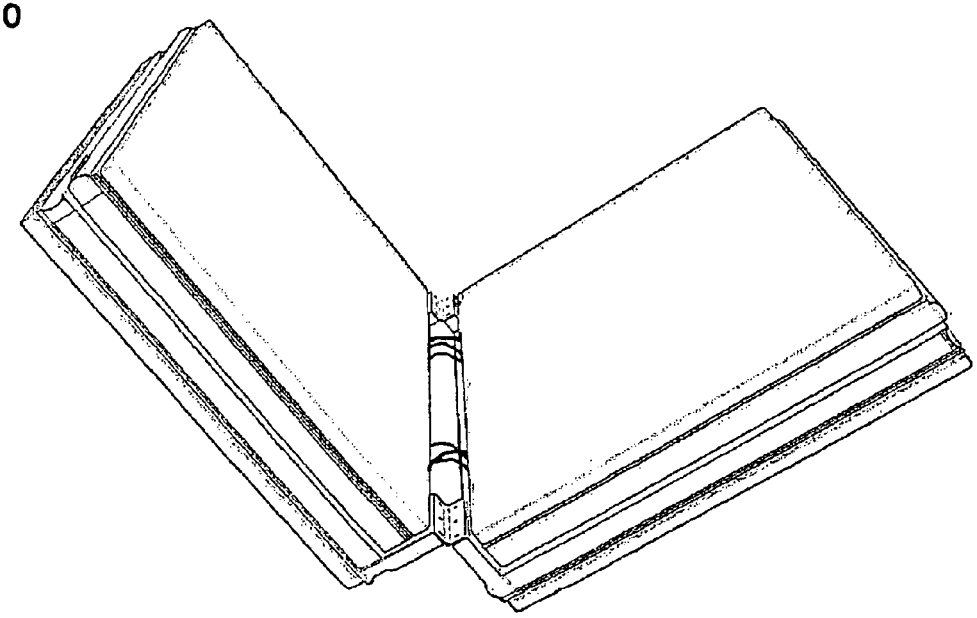

FIG. 10 shows the stage of folding according to the second and third alternative embodiments in which the two end elements are folded over the median elements.

Figure 11:
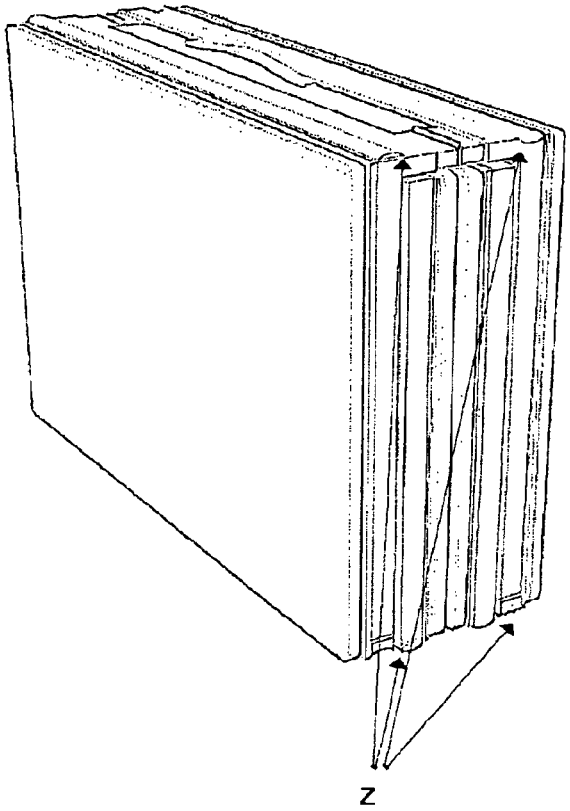

FIG. 11 is an elevation view of the table closed according to the second and the third embodiments.

Figure 12:
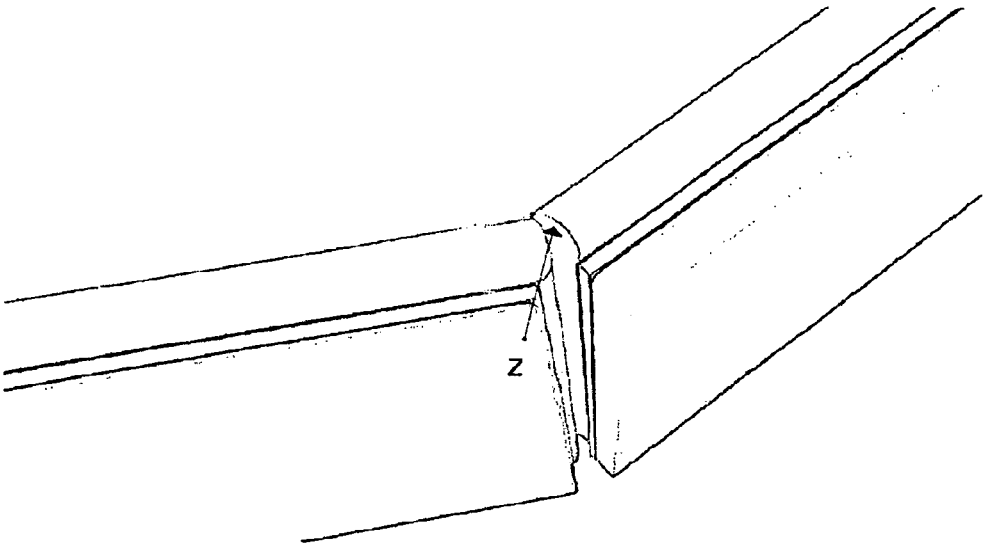

FIG. 12 shows a detail of the table illustrating one way to secure the four elements of the plate between them.

According to the first embodiment illustrated in FIGS. 1 to 5, the massage table consists of a rectangular plate 1 made of four elements approximately of the same length, 1*a*, 1*b*, 1*c*, 1*d*, the four elements being articulated to each other with articulations 14, 20*c*, the axis of which is perpendicular to the long side of the plate 1.

Each element consists of a rigid frame 2*a*, covered by a plate 2*b*, its self covered with foam 2*c* and upholstered. The two central elements 1*b*, 1*c* can be substantially wider than the end elements 1*a*, 1*d*. The parts 20*a*, 20*b* of the frames of the elements 1*b*, 1*c* are wider than the other parts of the frame so that the elements 1*a*, 1*d* can fold inside the elements 1*b*, respectively 1*c*, without projecting beyond these frames at these places (FIG. 4), they allow to maintain the central elements 1*b*, 1*c* aligned, these elements are substantially wider than the end elements 1*a*, 1*d* as shown in FIGS. 1, 2, 5 and 11 in order to fold the table.

Adjacent parts of the frames 2*a* of the central elements 1*b*, 1*c* can be wider in order to increase the resistance of the centre of the table. In this case the central elements 1*b*, 1*c* are slightly longer than the end elements 1*a*, 1*d* in order to fold the table.

At the four corners of the plate 1 are mounted the legs 3 each consisting of three parts. The first part 3*a* is articulated at the point b by an articulation on a part B fixed to the free end 2*a* of the frames of the end elements 1*a*, 1*d*. This first part 3*a* is extended by a second part 3*b*. This second part, connected to the first by an articulation 6 articulated at 6*c* has longitudinal ribs. The third lower part 3*c* of the leg has ribs corresponding to the ribs of the second part 3*b* and can slide thereon without lateral play, making it possible to adjust the height of the table. There are a series of holes 3*x* evenly distributed over the third part 3*c* which can coincide with a single opening of the second part 3*b*, fixation between the two parts can be made, for example, with a screw 30 passing through the two holes and a wing-nut, or similar, tightening the whole.

Alternatively, if one renounces to the height adjustment, legs can comprise only two parts articulated together.

On each side of the table there are two articulated braces, each one comprising several articulated arms, in the example shown there are two arms 7, 8 articulated in 30, 31, 32 connecting the inner part 2*a* in 32 of the end element 1*a*, respectively 1*d* to the second part 3*b* of the corresponding leg 3. There is also a mean, such as a part 9 connecting the articulated arms 7 and a part 10 connecting the articulated arms 8 associated with the element 1*a*, respectively 1*d*, making the whole rigid and preventing lateral movement of the table in its open position.

The stability of the table in the open position is ensured by a system of cables C1, C2, C3, exerting reverse tensions to the load distributed on the table on the different parts of the structure. A cable C1 is attached between the point b1 located above the leg 3 on a part B fixed to the frame 2*a*, and the articulation 31 between the articulated arms 7 and 8 of the braces. A cable C3 connects this same articulation 31 to the articulation 32 of the opposite end element. Finally, to lock the articulation between the two parts 3*a*, 3*b* of the legs 3 a cable C2 connects the leg 3 at a point situated above the point 30 of articulation of the leg 3 to the brace 7, 8, to the articulation 32 of the same end element 1*a*, respectively 1*d*. The cable C2 can be replaced by a hinge or self-locking hinge or a system to maintain aligned the two parts 3*a*, 3*b* of the legs 3. To improve the locking in the open position of the articulation 6 the cable C2 can be attached to a point 6*b* of the first part 3*a* of the leg 3 and slide on a part 6*a* of the second part 6*b* of the foot 3, and so exert a force F2 on the articulation 6. The elements 6*a* and 6*b* being offset from the articulation point 6*c* of the articulation 6 the force F2 will have the effect of holding the elements 3*a* and 3*b* aligned.

The same cable system is planned for the other legs. The lengths of these cables are adjusted so that they are tensioned in the open position of the table.

The end elements 1*a*, 1*d* of the plate 1 are kept aligned to their adjacent elements 1*b*, 1*c* by the two sets of triangulation made by the cables C1 and C3: b1, 31, 32 on one hand and 32, 31, 32 on the other hand. The two central elements 1*b*, 1*c* of the plate 1 are kept aligned together by the parts 20*a* and 20*b* of their frames, articulated in 20*c*. The same device is provided for the opposite sides of the frames (FIG. 1). Thus the weight of the patient on the table will result to tension the cables C3 and C1 which will exert a force opposite to the weight on the arm 8, involving triangulation b1, 31, 32, 32, 31, 32.

Figure 2:
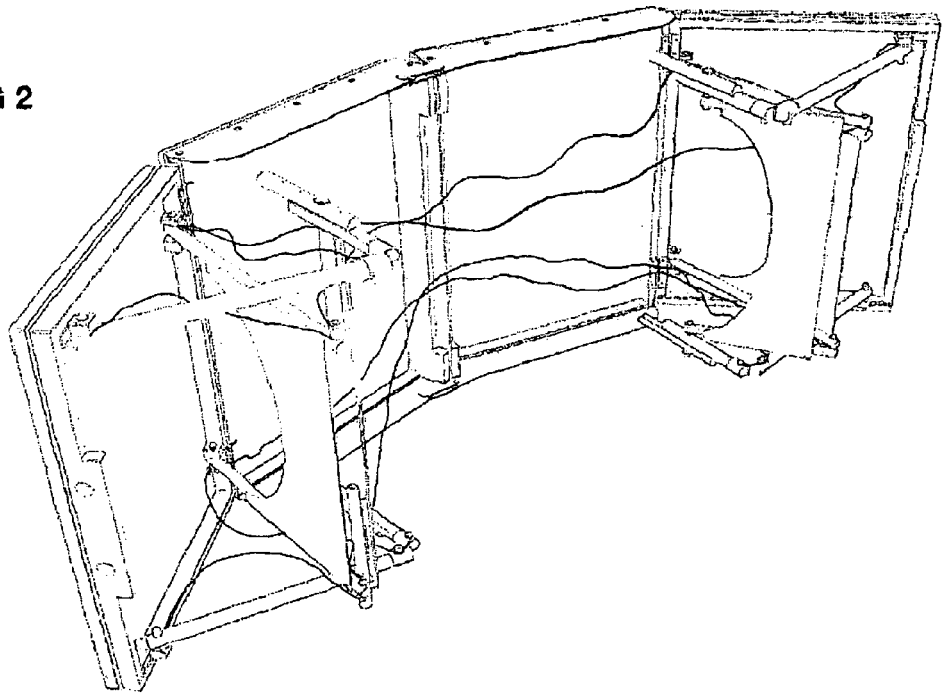
FIG. 2 shows a view of the table in an intermediate folding state.
Figure 3:
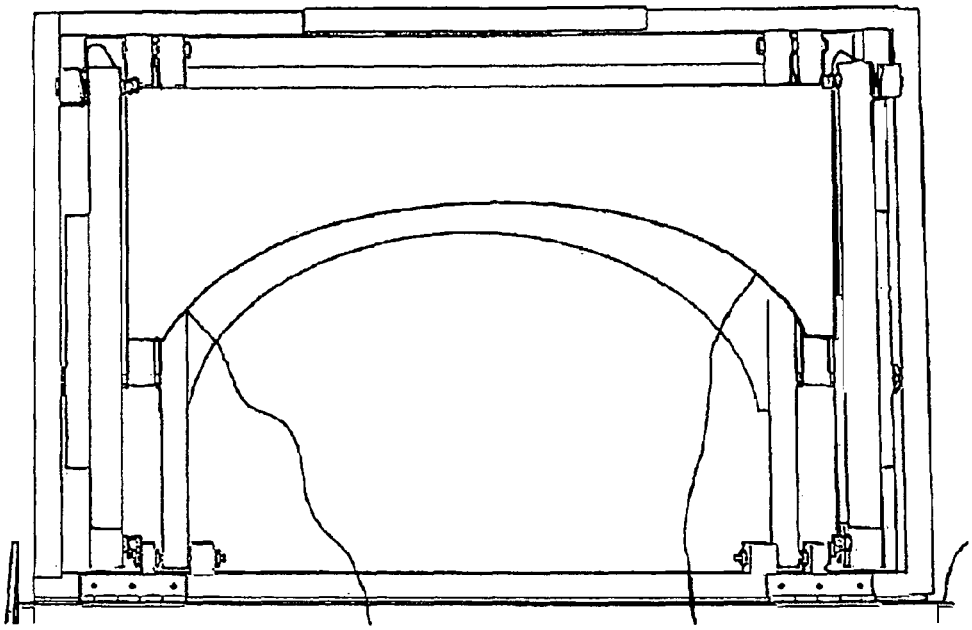
FIG. 3 is a bottom view of an end element of the plate with the legs folded inside.
Figure 4:
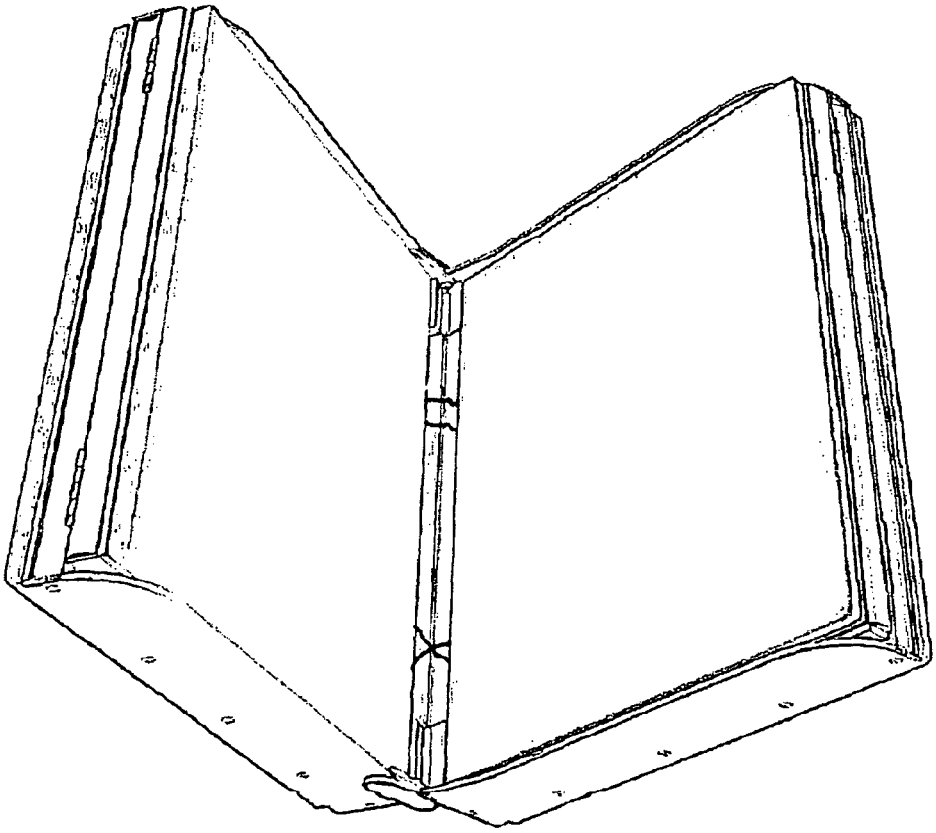
FIG. 4 shows the folding step in which the two end elements are folded over the median elements.
Figure 5:
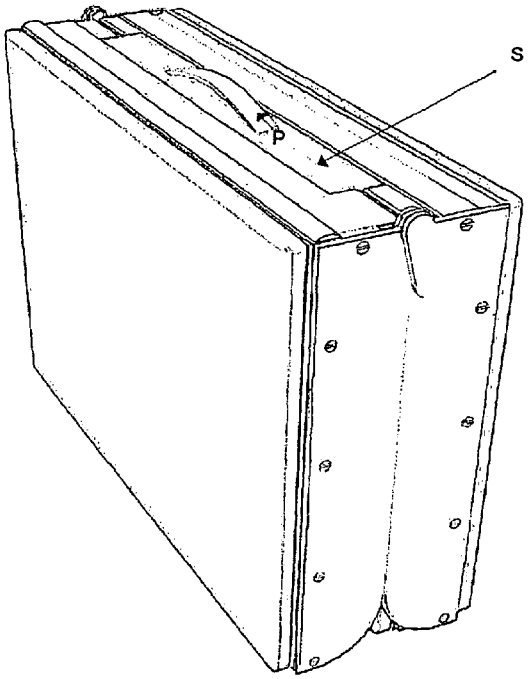
FIG. 5 is an elevation view of the table when closed.

In the open position of the table, to stabilize the position of the legs, it suffices to exert a pressure on the articulation 31 in the direction of the arrow F3, the braces 7 and 8 forming between them an obtuse angle. This pressure in 31 will cause tension to the cables C1 and C2 by the triangular forces and thus maintain aligned the elements 3*a* and 3*b* of the legs 3 perpendicular to the plate to make the whole rigid. To close the table, a pressure is exerted on the articulation 31 in the opposite direction of the arrow F3, which will release the cable tension C1 and C2. Once the cables are not under tension anymore, the articulated braces 7 and 8 can be folded in the frame of the element 1*a*, respectively 1*d*, as illustrated in FIGS. 2 and 3. Once the legs are retracted into the elements 1*a* and 1*d*, the elements 1*a*, respectively 1*c* can rotate a 180° on the articulations 14. Then the two pairs of elements rotate 90° on the articulation 20*c* (FIGS. 4 and 5). In this position the four elements 1*a*, 1*b*, 1*c* and 1*d* are superimposed on each other and the side walls of the frames 2*a* cover at least approximately completely the legs and braces folded, forming a compact structure not too bulky.

Since the end elements 1*a* and 1*d* are bearing the central elements 1*b* and 1*c*, in order to relieve the pressure on the articulation 14, there are additional blocking means Z, for example mortise or tenon, to secure in the open position the central elements 1*b*, 1*c*, with bearing end elements 1*a*, 1*d*, as shown in FIGS. 11 and 12. The same locking means may also be used between the central elements 1*b*, 1*c* for rigidifying the central part of the table and also to allow the second and third embodiments.

As shown in FIG. 1, parts 2*a* of the frames, at both ends of the table, may be wider on a portion of their length and have orifices 13 allowing for example the use of a face cradle.

A part S with a handle P can be fixed between the adjacent parts of the frames 1*b* and 1*c* (FIG. 5).

According to a first alternative embodiment shown in FIG. 1*b* a cable C3 replacing the cable C30 can be attached between the articulation 31 of the arms of the braces and a point 40 of the Central elements 1*b*, 1*c*.

According to a second embodiment (FIGS. 6 and 7) the cables C4 and C5 can replace the cables C3, the four elements (1*a*, 1*b*, 1*c*, 1*d*) are all of the same width or approximately the same width and the parts 20*a* and 20*b* of the central elements are eliminated. Elements 0 of adjacent parts of the central elements 1*b*, 1*c* make the frames broader in some places and are connected by hinges 14 in order to replace the articulation 20*c*. Parts M are fixed in N and articulated in n1 on the adjacent inner parts of the central frames 1*b*, 1*c* and fold into the table, in the open position of the table part M can pivot on its frame to reach the centre of the table at the junction of the cables C4 and C5 or remain upright, which implicates to slightly remove the junction point of the cables C4 and C5. The cable C4 is attached to the articulation 32 of the end elements 1*a* to 1*d*, the cable C5 is attached to the articulation 31 of the end elements 1*a* to 1*d*, these two cables pass through the orifice m1 in parts M, they are fastened together by a part X1, there are means for locking the part M so that it can not go beyond the point X1 when it unfolds: for example, the part X1 is equipped with a larger part that can not pass through the orifice m1, or the orifice m1 is smaller at one of its ends in order that the part X1, used to fixe the cables C5 and C4, can not cross it entirely. So the central elements 1*b* and 1*c* of the frame are kept aligned by the cable C4 exerting a force on the part M, vertical and opposite to the load located on the table and the end elements 1*a*, 1*d* are kept aligned by the cables C5 and C1 exerting a pressure on the brace 8 vertical and opposite to the charge located on the table. As illustrated in FIG. 7, the cables C4 and C5 can slide in m1 to let the part M fold into the table. There are also locking means Z in order to distribute the vertical load on the central adjacent elements 1*a*, 1*c*. If the cables C3 are not replaced by the cables C4 and C5, they are fixed at their intersection, or near their intersection, by a part X1 passing through the orifice m1 and will have the same function as the cables C4 and C5, C4 or C3 cables can be fixed to the top of the legs at points b1 and pass through a loop or a similar item attached to the articulation points 32 of the elements 1*a* and 1*d*.

In a third alternative embodiment (FIG. 8) cables C3 are kept, they pass through an orifice m1 of the part M that can be longer and have a second orifice m2. A cable C6 attached to the articulation 32 of the elements 1*a* to 1*d* passes through the point m1, or to relieve the cable, through the point m2. C6 cable can also be attached in b1 and pass through the articulation 32 or a part attached to the articulation 32. Cable C6 has the effect of maintaining the central elements 1*b* and 1*c* aligned. If the part M is fixed to the element 1*c*, the cable C3, attached to the articulation 31 of the bracing of the element 1*a*, may be fixed in m1, if the part M is fixed to the element 1*b* the cable C3 attached to the articulation 31 of the element 1*d* will be fixed in m1, this in order to unfold automatically the part M if it folds in the longitudinal direction of the table, and to fix it when unfolding the table, there is also the same locking means Z between the central elements 1*b*, 1*c* and also the same articulation system as in the second embodiment attached to the elements O of the adjacent parts of the central frames. In order to fold the part M in its frame, the cables C3 remained free and C6 slide through the openings m1 and m2 (FIG. 9). The cables C3 can be replaced by the cables C4 and C5 arranged in the same way as in the second embodiment, the cables C4 can also be attached to the top of the legs at the points b1 and go through a loop or similar part set at the articulations 32 of the elements 1*a* and 1*d*.

The invention claimed is:

1. A table is composed with a table top (1) comprising at least two end sections (1*a*, 1*d*) and two central sections mounted on rigid frames (2*a*) hinged together perpendicularly to long sides of the table top (1), means for locking the table in the erected position, legs (3), mounted on the table top, each leg being made of at least two parts (3*a*, 3*b*) hinged together, first parts (3*a*) are hinged (b) to end parts (B) of the end sections (1*a*, 1*d*), arms (7, 8) of bracing, comprising at least two arms (7, 8) hinged together at a joint (31) are hinged to a second part (3*b*) of each leg (3) and each inner end of the corresponding end sections (1*a*, 1*d*) of the table top (1), locking means between the arms (7, 8) of bracing and/or the legs (3) of each end section (1*a*, 1*d*) to prevent lateral movement of the table, means for linking the joints (31) between the arms (7, 8) of bracing to the end sections (1*a*, 1*d*) on which corresponding legs (3) are hinged, and means for locking the joints (6) between the parts (3*a*, 3*b*) of the legs (3) to hold the legs in an open position and render the whole rigid, the whole being designed in such a way that the legs and the arms (7, 8) of bracing of each half of the table, once folded, fold into the frames (2*a*) of the end sections (1*a*, 1*b*) and corresponding adjacent central sections (1*c*, 1*d*) and that all the sections, once folded, are superimposed.

2. The table of claim 1 comprising cables (C2) attached between the legs (3) and the joint between corresponding arms (7, 8) of bracing with the end sections (1*a*, 1*d*).

3. The table of claim 1 comprising cables (C1) attached between the joints (31) of the arms (7, 8) of the bracing and the end parts (B) of the end sections (1*a*, 1*d*).

4. The table of claim 1, wherein in a folded position, the frames (2*a*) cover at least approximately completely the legs (3) and the folded arms (7, 8) of bracing.

5. The table of claim 1, wherein each leg (3) comprises a third part (3*c*) sliding on the second part (3*b*) with means for fixing the two parts together in a desired position for adjusting the height of the table.

6. The table of claim 1, wherein supporting means of the central sections (1*b*, 1*c*) comprise surface elements (z) on adjacent parts of the frames (2*a*) between the end sections (1*a*, 1*d*) and the central sections (1*b*, 1*c*) such that vertical pressure exerted on the central sections (1*b*, 1*c*) is transmitted to the end sections (1*a*, 1*d*) and similar supporting means between the central sections (1*b*, 1*c*).

7. The table of claim 1, comprising cables (C3) attached longitudinally, on one side to the joints (31) between the arms (7, 8) of bracing, on the other side to the end sections (1*a*, 1*d*) of the opposite side of the table.

8. The table of claim 1, comprising cables (C3) attached longitudinally, on one side to the joints (31) between the arms (7, 8) of bracing, on the other side to the joints (32) of the arms (7, 8) of bracing with the end elements (1*a*, 1*d*) of the opposite side of the table.

9. The table of claim 1, comprising cables (C6) attached longitudinally between the opposite end sections (1*a*, 1*d*) and passing through a fixed point of the joints (32) of the arms (7, 8) of bracing with the end sections (1*a*, 1*d*) and through an orifice (m1 or m2) situated on central parts (M) hinged to an adjacent portion of the central sections (1*b*, 1*c*).

10. The table of claim 1, comprising cables (C6) attached longitudinally between the opposite end parts (B) of the end sections (1*a*, 1*d*) and passing through a fixed point of the joints (32) of arms (7, 8) of bracing with the end sections (1*a*, 1*d*) and through an orifice (m1 or m2) situated on central parts (M) hinged to an adjacent portion of the central sections (1*b*, 1*c*).

11. The table of claim 1, comprising cables (C6) attached longitudinally between the opposite joints (32) of the arms (7, 8) of bracing with the end sections (1*a*, 1*d*) and passing through an orifice (m1 or m2) situated on central parts (M) hinged to an adjacent portion of the central sections (1*b*, 1*c*).

* * * * *